United States Patent [19]

Mullet

[11] Patent Number: 4,635,400

[45] Date of Patent: Jan. 13, 1987

[54] OVERHEAD DOOR STOP

[76] Inventor: Willis Mullet, 3341 Edgewater Dr., Gulf Breeze, Fla. 32561

[21] Appl. No.: 755,850

[22] Filed: Jul. 17, 1985

[51] Int. Cl.[4] ..... E06B 1/04

[52] U.S. Cl. ..... 49/504; 52/214; 52/718.1

[58] Field of Search ..... 49/504, 505, 485; 52/213, 214, 717.1, 718.1, 402

[56] References Cited

U.S. PATENT DOCUMENTS

| | | | |
|---|---|---|---|
| 3,048,902 | 8/1962 | Hastings | 49/402 |
| 3,141,205 | 7/1964 | Russell | 49/504 |
| 3,242,537 | 3/1966 | Monti | 49/402 |
| 3,320,705 | 5/1967 | Downing | 49/504 |
| 4,527,369 | 7/1985 | Adams | 52/214 |

FOREIGN PATENT DOCUMENTS

| | | | |
|---|---|---|---|
| 635299 | 1/1964 | Belgium | 49/504 |
| 547862 | 10/1957 | Canada | 49/504 |
| 2445832 | 4/1976 | Fed. Rep. of Germany | 49/504 |

*Primary Examiner*—William E. Lyddane
*Assistant Examiner*—Gerald A. Anderson
*Attorney, Agent, or Firm*—Renner, Kenner, Greive, Bobak & Taylor

[57] ABSTRACT

A door stop (12) for sealingly abutting a movable overhead door (11) in closed position, comprising channels (20) of resilient material having forward and rearward legs (16 and 17) with their free ends adapted for abutting a door jamb (10), said forward legs (16) adapted to abut said jamb (10) and U-shaped fastening clips (24) for abutting said jamb (10) at spaced points longitudinally of said channels (20) and detachably interfitting said channels (20) for allowing longitudinal movement of said channels (20) relative to said clips (24).

6 Claims, 6 Drawing Figures

OVERHEAD DOOR STOP

TECHNICAL FIELD

This invention relates to door stops acting as perimeter seals against air infiltration around the sides and top of an overhead door when it is closed.

BACKGROUND OF THE INVENTION

Certain prior door stops for overhead doors have been of wood and have been disadvantageous because the wood stop must be mounted a sufficient distance from the door to allow for swelling of the wood due to weather conditions causing binding of the door. Such clearance results in a gap allowing air infiltration to occur. Further, such door stops require painting at frequent intervals to maintain the proper clearance from the door and to inhibit wood decay. Also, nails typically used to fasten such door stops are subject to corrosion causing unsightly rust streaks.

Certain other prior constructions include door stops of molded or extruded plastic material which require clearance from the door and thus do not provide a sealing contact with the door surface. Attempts to remedy this deficiency have included extending a flexible sealing strip from the door stop, but in use repeated openings and closings of the door have distorted the sealing strip and destroyed its effectiveness. Also, these door stops of formed plastic material require exposed fasteners subject to corrosion.

A solid contact between the stop surface and the door is necessary because of a clearance requirement between the rollers on the door and the track guiding the rollers. It is very desirable that the door stop be positioned so that as the door approaches fully closed position, a wedging action takes place with the door stop as provided for by the clearance between the rollers and track. Otherwise, the only contact between the door and stop is with the flexible strip which is subject to distortion in use.

Other prior constructions include stops having substantially flat metal strips mounting discrete flexible strips of vinyl material or the like extending therefrom to make sealing contact with the door surface. Difficulty is had with this stop due to the lack of surface contact between the stop per se and the door which is required to take up the clearance between rollers and track as discussed above, and which results in relying solely on contact with the distortable flexible material when the door is closed. Also, such constructions require exposed fasteners which are subject to corrosion.

A further disadvantage of these formed plastic and metal door strips is that because of the substantial differences in coefficient of expansion between the door stop and the door jamb to which it is fastened, the stop expands and contracts between the spaced fastening points, resulting in gaps in the sealing surface of the stop as well as an unsightly appearance.

DISCLOSURE OF THE INVENTION

The present invention is designed and adapted to overcome the deficiencies of the foregoing prior constructions, and is economical of construction and installation, maintenance-free and easily replaceable.

It is therefore an object of the present invention to provide an improved door stop which overcomes the deficiences of prior door stops, and embodies additional advantages over the same.

Another and more specific object is to provide an improved door stop which has novel fastening means allowing linear expansion and contraction of the stop thereby avoiding gapping between door stop and jamb between fixed fastening locations, typical of stops and fixed fasteners, which results in air infiltration between jamb and door stop.

Another object is to provide concealed means for fastening the stop to the jamb thereby avoiding unsightly exposed nail heads subject to corrosion, and making the stop easily replaceable.

A further object is to provide a door stop which does not require maintenance such as painting, but is adapted to be painted for color matching purposes.

A still further object of the invention is to provide an improved door stop which provides a solid contact surface with the door in fully closed position with or without the addition of a flexible sealing strip.

These and other objects are accomplished by the improvements comprising the present invention, preferred embodiments of which are disclosed herein as illustrating the best known modes of carrying out the invention. Various changes in details of construction and modifications thereof are comprehended within the scope of the appended claims.

PREFERRED MODE FOR CARRYING OUT THE INVENTION

Figure 1:
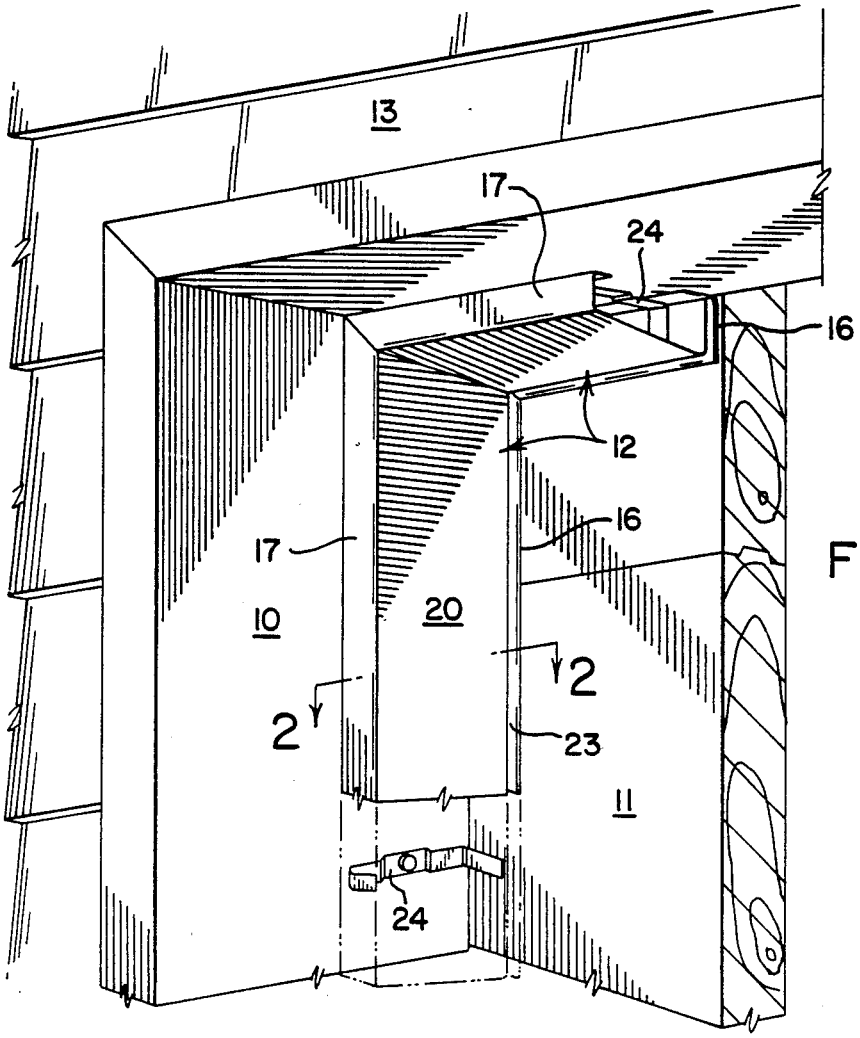
FIG. 1 is a partial assembly view in perspective, showing the improved door stop installed on the door jamb and in sealing contact with an overhead door in closed position.

Referring to FIG. 1, a door jamb indicated generally at 10 defines the door opening for an overhead door 11 abutting the improved door stop, indicated generally at 12, mounted on the door jamb 10. The jamb is suitably attached to a wall or the like indicated generally at 13.

Preferably, the improved door stop comprises channels 12 extending along the sides and top of the door opening, being generally U-shaped in cross section and preferably formed from a single piece of resilient sheet metal. The open side of each channel abuts the inner surface of the jamb 10 and the free ends of the forward and rearward legs 16 and 17 terminate in inturned flanges 18 and 19, respectively, and are adapted for abutting the inner surface of the jamb 10. The web 20 connecting the legs is preferably slightly tapered inwardly from front to back.

Figure 2:
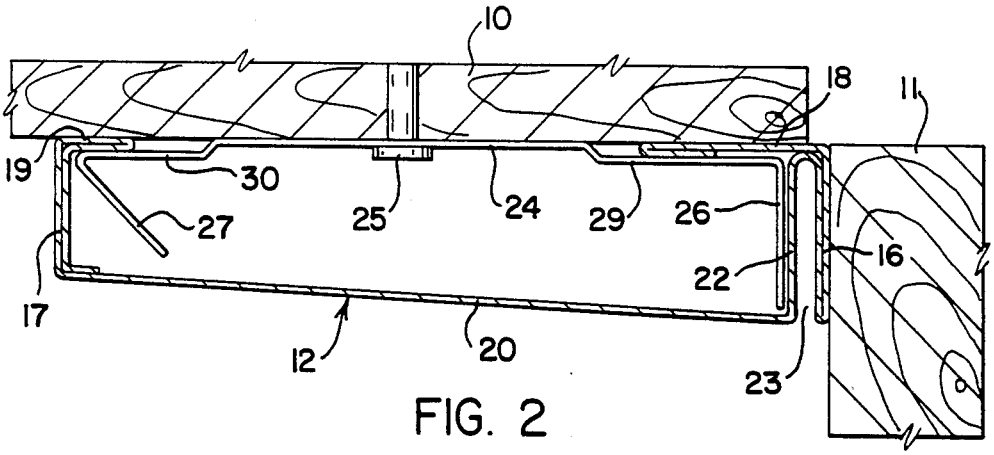
FIG. 2 is a cross-sectional view thereof on line 2—2 of FIG. 1.

The forward leg 16 of each channel is connected to the web 20 by a reversely bent leg 22 which forms with leg 16 a U-shaped transverse open slot 23. This provides leg 16 with resiliency allowing it to flex, resulting in improved sealing abutment with the door in closed position as indicated in FIG. 2.

Figure 3:
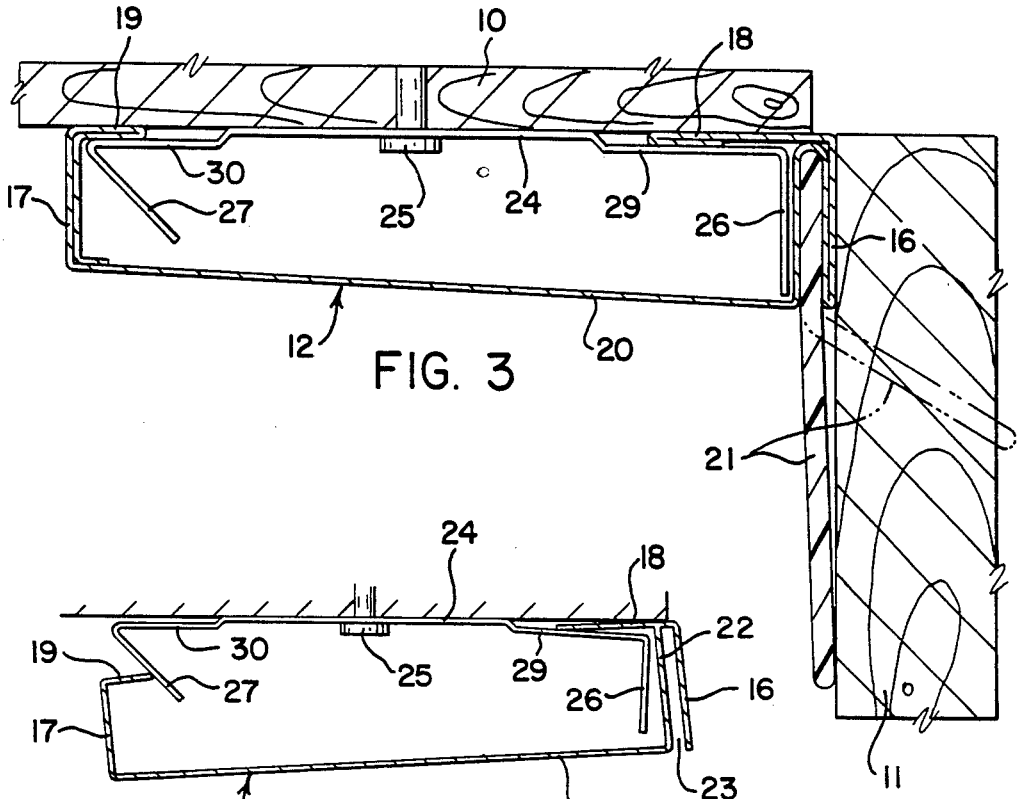
FIG. 3 is a view similar to FIG. 2 showing a modification in which a flexible sealing strip is mounted on the door stop.

As shown in the modification of FIG. 3, the slot 23 may be used to receive and mount one edge portion of a resilient strip 21 of plastic material or the like for making additional sealing contact with the door 11 at its other edge.

The novel means for fastening the improved stop to the door jamb 10 comprises resilient clips 24 of metal or the like adapted to be secured to the jamb by screws 25 at about 36-inch intervals longitudinally of the door stop channels. Each fastening clip 24 has outturned forward and rearward flanges 26 and 27 fitting within the forward and rearward channel legs 22 and 17, respectively, of the stop 12.

The web of each clip 24 has forward and rearward outwardly offset portions 29 and 30 spaced from the jamb 10, to slidingly receive flanges 18 and 19 of the stop 12. This is a very important feature as it compensates for longitudinal expansion and contraction of the stop channels resulting in imperfect and uneven sealing surfaces between door stop and jamb, a typical problem with door stops with fixed fasteners. Moreover, this slidable contact of the channels on the fastening clips results in improved sealing contact with the door as it is wedged into final closing position.

Figure 4:
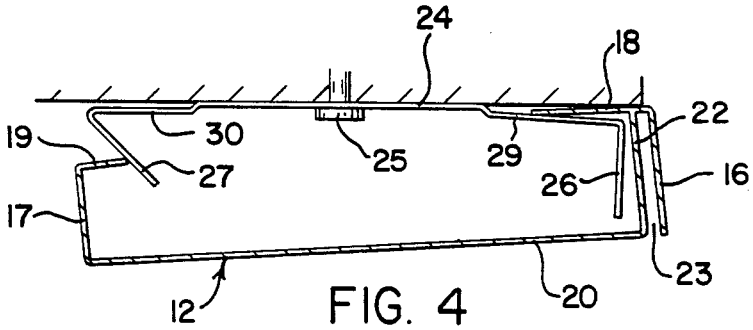
FIGS. 4–6 are sectional views similar to FIG. 2, showing progressively how the improved stop is detachably mounted on improved fastening strips secured at longitudinal intervals to the door jamb.
Figure 5:
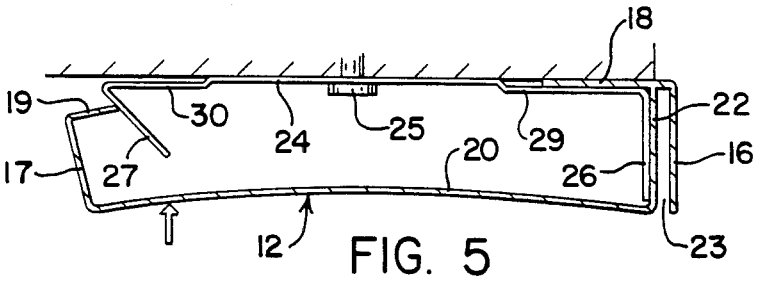
Figure 6:
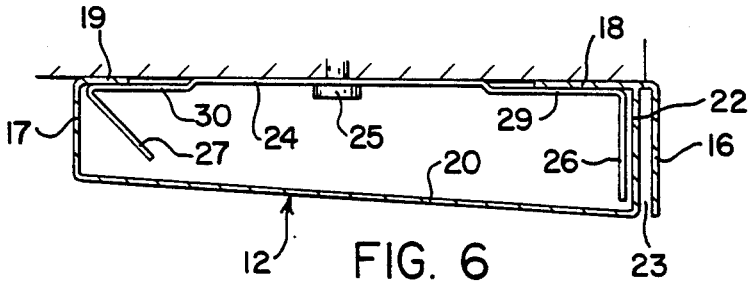

The flange 26 of each clip 24 is turned outwardly at 90° from offset portion 29, and the flange 27 is turned outwardly at an acute angle. The manner of attaching the stop channels to the fastening strips is shown in FIGS. 4–6. As shown in FIG. 4, the acutely angled leg 27 allows the leg 22 of the stop to be moved over and around leg 26 of the fastening clip as the forward flange 18 of the stop slides behind web portion 29 of the fastening clip 24. Then by bending the web 20 of the stop concavely as shown in FIG. 5, the rearward flange 17 of the stop can be pushed inwardly to slide over the angled leg 27 and snap behind offset portion 30 of the fastener clip 24 to the final position of FIG. 6, wherein web 24 has sprung back to original shape and the stop channel is slidably mounted on the fastener clip for longitudinal movement compensating for expansion and contraction of the stop.

Installation of the door stop is the last step during door installation. With the door in closed position, the clips are mounted on the door jamb at 36-inch intervals, the door being used to gauge the horizontal positioning of the clips which are fastened with about a 1/16 inch gap between the clips and the door. Then the door is raised and the stop channels applied as previously described. Since the location of the door stop channels is predetermined by the pre-location of the clips, the installation is less cumbersome than with conventional doors.

It will be apparent that the concealed fastener clips of the improved door stop enhance its appearance, are maintenance-free and eliminate the problem of corrosion and discoloration present with external fasteners, thus affording corrosion-free surfaces for painting for color matching purposes. The door stop channels are easily applied to and easily detached from the clips, using a small screwdriver to wedge out the rearward leg of the channel.

Moreover, the forward leg of the stop provides a limited narrow and resilient contact surface with the door, ensuring a good seal while providing a solid surface contacting the door, thus taking up the required clearance between the door rollers and the track. The slidable contact between the door stop channels and the fastening clips allowing the channels to expand and contract longitudinally relative to the clip eliminates unsightly rippling and distortion of the channels which detracts from the efficiency of the seals resulting in air infiltration.

The improved door stop construction involves substantial savings in material and production costs as compared with conventional door stops.

I claim:

1. A door stop for sealingly abutting a movable overhead door in closed position, comprising a channel of resilient material having forward and rearward legs and a web connecting said legs, said forward leg adapted to sealingly abut a movable door, the free ends of said legs have inturned flanges for abutting a door jamb, a fastening clip having forward and rearward flanges and a web connecting said flanges, said web adapted to be secured to the door jamb, said clip flanges, detachably interfitting said channel legs, and the rear flange of said clip being acutely angled to allow the inturned flange of said rear channel leg to slide over and resiliently snap behind the web of said clip, said forward leg of said channel being reversely bent to form a transverse open slot thereunder to allow the leg to flex.

2. A door stop as in claim 1, wherein the web of the clip has offset portions forming spaces to slidably receive the inturned flanges of the channel legs between said clip web and said jamb, allowing linear movement of said channel relative to said clip.

3. A door stop as in claim 2, wherein said clip is normally entirely concealed within said channel, providing the exterior of said channel with a smooth surface for painting.

4. In combination with an overhead door for closing an opening defined by a door jamb, a door stop mounted on said jamb and adapted to sealingly abut said door in closed position, said door stop comprising a channel of resilient material having forward and rearward legs and a web connecting said legs, said forward leg adapted to abut said door, the free ends of said channel having inturned flanges abutting said jamb, fastening clips attached to said jamb at spaced points longitudinally of said channel and having forward and rearward flanges and a web connecting said flanges, said webs secured to said jambs, said clip flanges detachably interfitting said channel legs, and the rear flange of each clip being acutely angled to allow the inturned flange of said rear channel leg to slide over and resiliently snap behind the web of said clip, said forward leg of said channel being reversely bent to form a transverse open slot thereunder to allow the leg to flex.

5. A door stop as in claim 4, wherein the web of the clip has offset portions forming spaces to slidably receive the inturned flanges of the channel legs between said clip web and said jamb, allowing linear movement of said channel relative to said clips.

6. A door stop as in claim 5, wherein said clips are normally concealed within said channel, providing it with a smooth, unbroken exterior surface for painting.

* * * * *